US005168316A

United States Patent [19]

Hino et al.

[11] Patent Number: 5,168,316

[45] Date of Patent: Dec. 1, 1992

[54] SHEER FEEDING CONTROL MECHANISM FOR AN IMAGE FORMING APPARATUS

[75] Inventors: Rika Hino, Tokyo; Yasufumi Tanimoto, Fujisawa, both of Japan

[73] Assignee: Kabushiki Kaisha Toshiba, Kawasaki, Japan

[21] Appl. No.: 669,108

[22] Filed: Mar. 13, 1991

[30] Foreign Application Priority Data

Mar. 13, 1990 [JP] Japan ..... 2-61521

[51] Int. Cl.[5] ..... G03G 15/00

[52] U.S. Cl. ..... 355/309; 355/313; 271/9

[58] Field of Search ..... 355/705-707, 355/309, 311, 313; 271/9; 346/134; 395/111

[56] References Cited

U.S. PATENT DOCUMENTS 4,763,889 8/1988 Dei et al. ..... 355/311 X
4,908,672 3/1990 Ito ..... 355/311

FOREIGN PATENT DOCUMENTS 52-10142 1/1977 Japan .
60-52439 3/1985 Japan ..... 271/9
60-144255 7/1985 Japan .
60-262741 12/1985 Japan ..... 271/9

*Primary Examiner*—Joan H. Pendegrass
*Attorney, Agent, or Firm*—Foley & Lardner

[57] ABSTRACT

An image forming apparatus is so constructed that, even when, during a portion of a processing for feeding the medium from one of a plurality of medium storage sections, the medium storage section involved becomes empty in the case where there exists, in the other medium storage section or sections, those mediums equal to or greater than the aforementioned medium which are not to be continuously fed, it is possible to continuously feed a medium from the medium storage section only arbitrarily selected in accordance with the order of priority.

2 Claims, 12 Drawing Sheets

100a

P - CHANGE : AUTO

FIG. 4

AUTO : M-U

FIG. 5

AUTO : M-U-L

FIG. 6

AUTO : M-U-L-E

FIG. 7

AUTO : M-L

FIG. 8

AUTO : M-L-E

FIG. 9

AUTO : M-E

FIG. 10

AUTO : M-E-U

FIG. 11

AUTO : U-L

FIG. 12

AUTO : U-L-E

FIG. 13

AUTO : L-E

FIG. 14

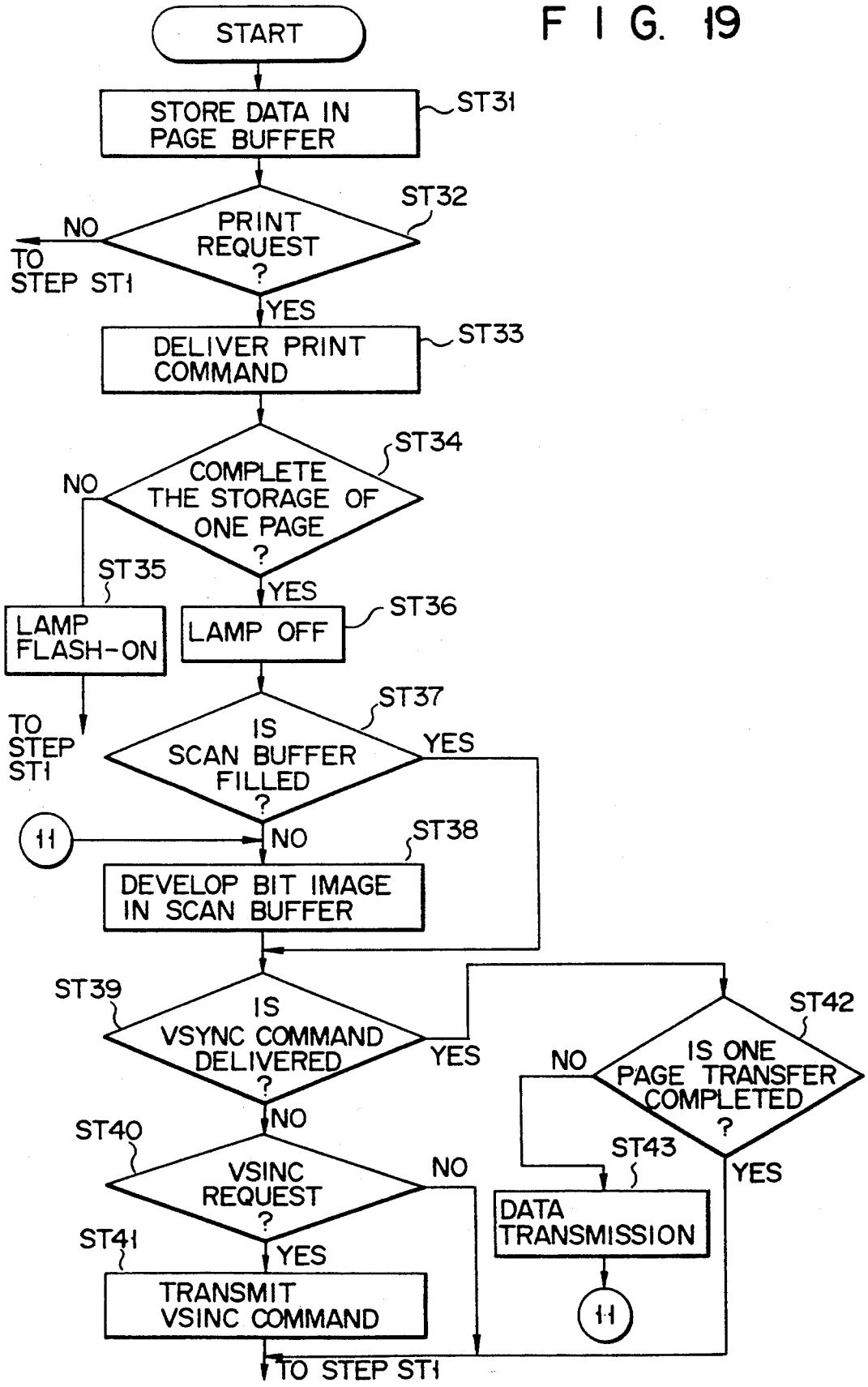
FIG. 19
START
STORE DATA IN PAGE BUFFER
ST31
PRINT REQUEST ?
ST32
NO
TO STEP ST1
YES
DELIVER PRINT COMMAND
ST33
COMPLETE THE STORAGE OF ONE PAGE ?
ST34
NO
YES
ST35
LAMP FLASH-ON
LAMP OFF
ST36
TO STEP ST1
IS SCAN BUFFER FILLED ?
ST37
YES
11
NO
ST38
DEVELOP BIT IMAGE IN SCAN BUFFER
ST39
IS VSYNC COMMAND DELIVERED ?
YES
NO
ST40
VSINC REQUEST ?
NO
ST41
YES
TRANSMIT VSINC COMMAND
TO STEP ST1
ST42
IS ONE PAGE TRANSFER COMPLETED ?
NO
YES
ST43
DATA TRANSMISSION
11

SHEER FEEDING CONTROL MECHANISM FOR AN IMAGE FORMING APPARATUS

BACKGROUND OF THE INVENTION

1. Field of the Invention

The present invention relates to an improved image forming apparatus.

2. DESCRIPTION OF THE RELATED ART

Published Unexamined Japanese Patent Application 52-10142 discloses an image forming apparatus, such as a laser printer, for selecting one of a plurality of sheet storage sections, forming an image on a sheet fed from the sheet storage section selected and, when the sheet storage section involved becomes empty, automatically feeding a sheet from another sheet storage section, so long as the sheet is of the same size as that in the previous sheet storage section, irrespective of the direction in which it is fed in the apparatus, whereby a continued processing is carried out.

Published Unexamined Japanese Patent Application 60-144,255 discloses the technique of providing an auto-change selection input means for selecting a continuation sheet feeding mode and, when the sheet storage section involved becomes empty, automatically feeding a 25 sheet from another storage section when it is of the same size as that in the previous storage section and only when the auto-change selection input means is selected.

It is also known that, when a sheet storage section is empty, a sheet is fed from another sheet storage section, in which case use is made of only a sheet whose size is equal to or greater than that of the sheet in the former sheet storage section.

As set out above, even when a designated sheet storage section becomes empty, another sheet is continuously fed from another sheet storage section so long as it is equal to, or greater than, the former sheet with respect to its size.

In the prior art, one storage section stores plain paper sheets while, on the other hand, another storage section stores, for example, letter heads as sheets. Even if these sheets are to be used in a discriminating way, they are, so long as being equal to or greater than each other in size, fed to the image formation section irrespective of their different kinds. In the case where use is made of such a sheet as a letter head which is not desired to be fed continuously with the plain sheet, a continuous feeding function cannot be carried out in the conventional apparatus.

SUMMARY OF THE INVENTION

It is accordingly the object of the present invention to provide an image forming apparatus which, in the case where some of a plurality of sheet storage sections holds those sheets of equal or greater size which are not desired to be fed continuously with those in another sheet storage section, can feed them from only the sheet storage section arbitrarily selected in accordance with the order of priority, and to an image forming apparatus equipped with the recording medium feeding apparatus.

In order to achieve the aforementioned object, there is provided an image forming apparatus comprising:

a plurality of housing members for accomodating a recording medium, respectively;

means for feeding the recording medium from one of the housing members;

means for forming an image on the recording medium fed from the housining means by the feeding means;

means, operable by an operator of the image forming apparatus, for determining an order of the feeding operation of the feeding means with respect to the housing members;

means for selecting a first housing member which is determined as a first order of the feeding operation by the determining means; and means for operating the selecting means to switch-over from the first housing member to a second housing member which is as a second order of the feeding operation by the determining means when the recording medium in the first housing member is a present amount, so as to continuously feed the recording medium by the feeding means.

According to the present invention, use is made of the selecting unit as set out above and, even if some of a plurality of storage sections for storing mediums of equal or greater size holds such mediums as letter heads which are not desired to be fed continuously with the medium in the storage section previously selected by the selecting unit for an image to be formed thereon, any desired medium can be fed from another storage section selected by the selecting unit in accordance with the order of priority so that it is supplied continuously with the medium in the previously selected storage section in which case those undesired sheets such as letter heads are excluded. Further, it is possible, according to the present invention, to feed only a medium or mediums of any desired size from any desired corresponding storage section selected by the selecting unit in accordance with the order of priority, and hence to readily impart a continuous medium feeding function to the apparatus.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 4 is a view showing one form of display corresponding to a continuous feeding function set mode as displayed on a liquid crystal display unit of the operation panel of FIG. 3;

FIGS. 5 to 14 are views showing a display state on the liquid crystal display unit when a continuous sheet feeding function set mode is involved;

FIGS. 18A and 18B, 19 are a flow chart showing the operation of the printer control circuit shown in FIG. 15.

DETAILED DESCRIPTION OF THE PREFERRED EMBODIMENTS

The embodiment of the present invention will be explained below with reference to the accompanying drawings.

Figure 1:
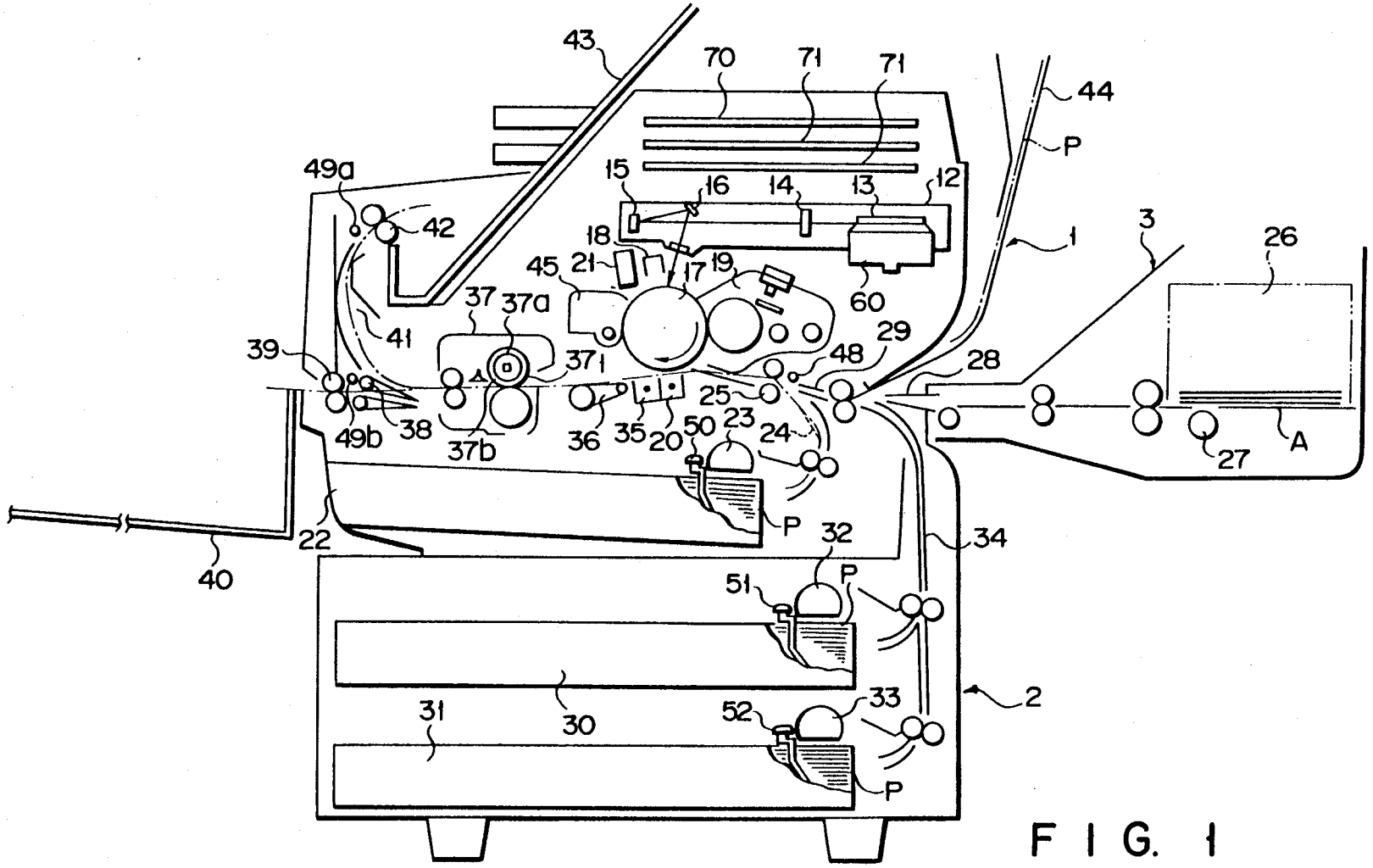
FIG. 1 is a diagrammatic view generally showing an inner arrangement of a laser printer as an image forming apparatus.
Figure 2:
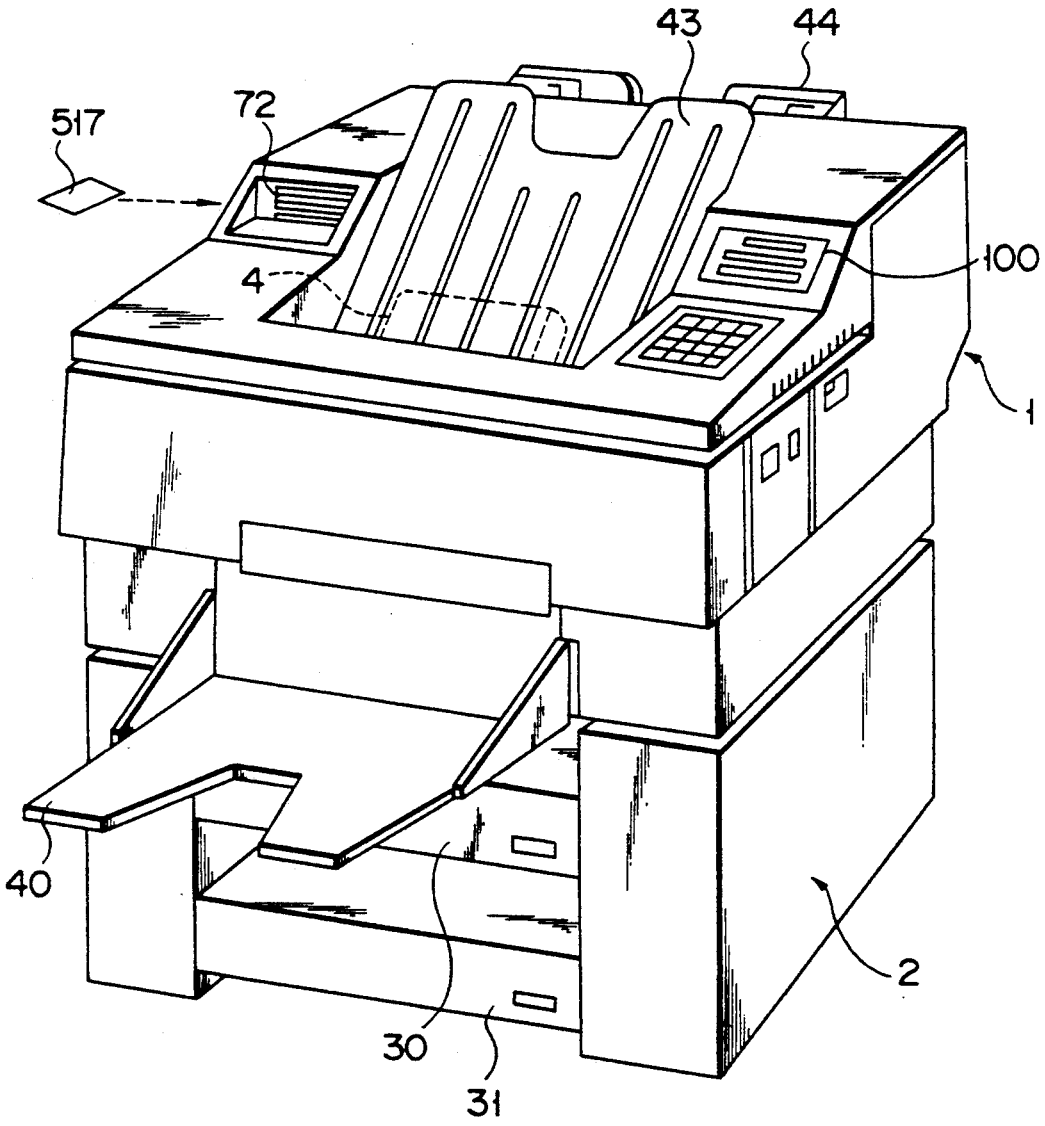
FIG. 2 is a perspective view showing an outer appearance of the laser printer shown in FIG. 1.

FIGS. 1 and 2 show an image forming apparatus of the present invention, that is, an image formation unit apparatus such as a laser printer equipped with option units. That is, the image formation unit apparatus comprises a laser printer 1 and option units, such as a multi-cassette feeder 2, an envelope feeder 3 and a jogger 4, connected to the laser printer, the multi-cassette feeder 2 feeding a sheet (plain paper) of given thickness, such as cut paper as an image formation medium, into the laser printer 1, an envelope feeder 3 feeding a sheet A (a thicker sheet), such as an envelope as a material for allowing an image to be transferred thereto, into the laser printer 1 and the jogger 4 acting as a sorter for sorting the sheet P or thicker sheet A with an image formed thereon or transferred thereto. The multi-cassette feeder 2, an envelope feeder 3 and a jogger 4 are connected, in on-line fashion, to a control section, not shown, in a body of the laser printer 1. An operation panel 100 is provided on the upper surface of the laser printer 1.

The laser printer 1 contains, for example, a laser optical system, photosensitive drum 17, charger 18, developing unit 19, transfer unit 20, discharger 21, separating unit 35, fixing unit 37 and cleaning unit 45, all constituting a processing system, as well as a sheet feeding cassette (holding means) 22, delivery roller 23, pair of aligning rollers 25, conveying belt 36, gate 38 and pairs of sheet discharging rollers (39, 42). The laser optical system 12 comprises a semiconductor laser oscillator, not shown, for generating a laser beam, a collimator lens, not shown, for correcting a laser beam originating from the laser oscillator to parallel light, polygon mirror 13 as a rotating body having an octahedral mirror section for reflecting the laser beam coming from the lens in units of one scanning line, f.$\theta$ lens 14, mirrors 15, 16, mirror motor 60 for rotating (driving) the polygon mirror 13, and so on.

At a time of image formation operation, a laser beam from the laser optical system 12 corresponding to an image signal coming from an external unit, not shown, is directed as an image to the surface of the photosensitive drum 17. The photosensitive drum 17 is rotated in a direction as indicated by an arrow in FIG. 1 and the surface of the drum is charged by the charger 18 and subjected by the optical system 12 to an exposure corresponding to the image signal. That is, the laser beam originating from the semiconductor laser oscillator is formed as an electrostatic latent image to the surface of the photosensitive drum 17, through its scanning made at a constant speed with the rotation of the polygon mirror 13 by the mirror motor 60, at which time the photosensitive drum 17 is being rotated in a clockwise direction. Toner is deposited by the developing unit 19 on the electrostatic latent image on the drum surface to allow the latent image to be visualized.

The sheets P of the sheet feeding cassette 22 are taken one by one through the delivery roller 23 and guided via a sheet guide path 24 into a nip of the pair of aligning rollers 25 and from there to the transfer unit.

The sheets P taken one by one, at a delivery outlet 32, from a sheet feeding cassette (holding means) 30 in a multi-cassette feeder 2 and fed past sheet guide paths 34, 29 to the aligning rollers 25, the sheets P taken one by one, at a delivery roller 33, from a sheet feeding cassette 33 fed past sheet guide paths 34, 29 to the aligning rollers 25, the sheets A taken one by one, at a delivery roller 27, from a stacker (holding means) 26 in the envelope feeder 3 and fed past the sheet guide paths 28, 29 to the aligning rollers 25, and the sheet P fed from a manual feeding section 44 past the sheet guide path 9 to the aligning rollers 25 are supplied to the transfer unit in accordance with a designation made from the external device or operation panel 100.

The sheet P or the sheet A thus fed to the transfer unit is brought, by the transfer device 20, into close contact with the surface of the photosensitive drum 17 and a toner image on the photosensitive drum 17 is transferred to the sheet under the action of the transfer unit 20. The image bearing sheet P or A is separated from the photosensitive drum 17 under the action of the separating unit 35 and fed by the conveying belt 36 to the fixing unit 37 where the image on the sheet is thermally fixed by heat originating from a heat roller $37_1$. A heat lamp 37*a* for heating is incorporated in the heat roller $37_1$. The image-fixed sheet P or A is discharged via the gate 38 and discharge rollers 39 onto a discharge tray 40 or is fed via the gate 38 to an upper conveying path 41 and from there via the discharge rollers 42 to a discharge tray 43.

After the image transfer, the photosensitive drum 17 has its residual toner eliminated by a cleaning unit 45 and its residual image eliminated by the discharger 21 in readiness for the next image formation operation.

The fixing unit 37 is made as a single unit, independently detachable from the laser printer 1. Behind the aligning rollers 25 is provided an aligning switch 48 for detecting a misfeed, by the aligning rollers 25, etc., to the transfer unit. Also behind the discharge rollers 39 and 42 are provided discharge switches 49*b* and 49*a*, respectively, which detect a discharge error caused by the discharge rollers 39 and 42.

Detectors 50, 51 and 52 for detecting the sheet P are located in the sheet feeding cassettes 22, 30 and 31, respectively, to detect the presence or absence of the sheets P in the sheet feeding cassettes 22, 30 and 31.

Above the laser optical system is an engine control substrate having an engine control circuit 70 adapted to control each electric unit in the apparatus body 1 and hence to control the operation of achieving an electrophotographic process and substrates having a printer control circuit 71 adapted to control the operation of the engine control circuit 70.

Three substrates having printer control circuits 71 can be attached at the most, in accordance with the range of functions added, such as the addition of typeface and characters. Thus a function can be performed by inserting function addition IC cards 517 into an IC card connector 72, at three locations, provided at the leading edge portions of the lowest substrate having the printer control circuit 71. A connector, not shown, is located at the left end of the lowest substrate having the printer control circuit 71 and is connected to a host unit 409 (FIG. 15) as an external output device such as an electronic computer and word processor.

Figure 3:
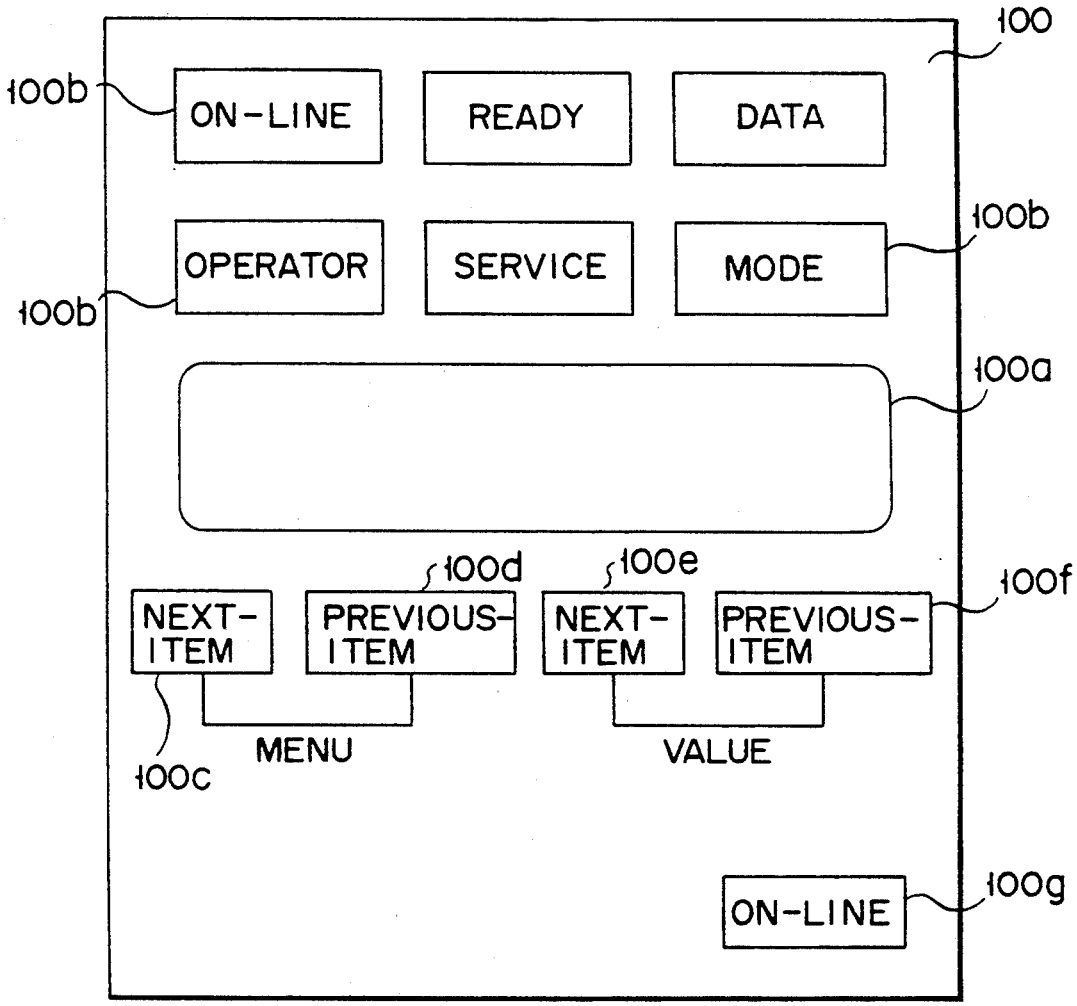
FIG. 3 is a plan view showing an operation panel on the laser printer shown in FIG. 2.

An operation panel 100 includes, as shown in FIG. 3, a liquid crystal display unit 100*a* for displaying the number of sheets, operating modes, information messages, etc., LED display units 100*b* displaying various states in lit fashion, a menu next-term key 100*c*, menu preceding-term key 100*d*, value next-term key 100*e*, value preceding-term key 100*f* for designating various operations and an on-line key 100*g* for making a switching between on-line and off-line for the host unit 409 (FIG. 17) as an external output device. The LED display unit 100*b*, . . . comprise a display unit "ON-LINE" displaying a connection or disconnection to and from the external unit, that is, a on-line/off-line mode, a display unit "READY" displaying an enable state of the apparatus body 1, a display unit "DATA" displaying an image in transfer, a display unit "OPERATOR" calling for an operator call, a display unit displaying "SERVICE" calling for a service call and a display unit "MODE" displaying an auto/manual mode.

A plurality of menu information are incremented upon each depression of the menu next-item key 100*c* and decremented upon each depression of the menu preceding-item key 100*d*, that is, these display operations are repeated in cyclic fashion. Further, a plurality of value information corresponding to the menu information displayed on a left half of the liquid display unit 100*a* are incremented upon each depression of the value next-item key 100*e* and decremented upon each depression of the value preceding-item key to display each result on the right half of the liquid crystal display unit 100*a*. In this way, such display operations are carried out in cyclic fashion. A continuation function setting mode is provided as the menu information. The "continued" state is set by the continuation function setting mode.

By operating the menu next-item key 100*c*, menu previous-item key 100*d*, value next-item key 100*e* and value preceding-item key 100*f*, an operator select a desired operation and gives a corresponding designation to an associated part.

For example, a menu is sequentially displayed by depressing the menu next-item key 100*c* and a menu [P-CHANGE:AUTO] as the continuation function setting mode is displayed on the liquid crystal display unit 100*a* as shown in FIG. 4. Here upon the depression of the value next-item key 100*e* a cyclic display AUTO→NO→AUTO is made. With the display "AUTO" on the liquid crystal display unit 100*a*, if the menu next-item key 100*c* is depressed, it is determined that an auto change range is set. Here the sheet feeding cassette 22 is represented by M, the sheet feeding cassette 30 of the multi-cassette feeder 2 by U, the sheet feeding cassette 31 of the multi-cassette feeder 2 by L, and the stacker 26 of the envelope feeder 3 by E. In this case, for example, the display [AUTO:M-U] is made on the liquid crystal display unit 100*a* as shown in FIG. 5. Upon the depression of the value next-item key 100*e*, the displays [M-U-L], [M-U-L-E], [M-L], [M-L-E], [M-E], [M-E-U], [U-L], [U-L-E] and [L-E] are cyclically displayed on the right side of the liquid crystal display 100*a* as shown in FIGS. 6 to 14. These display contents represent an automatic change range, namely, the priority order for the continuation sheet feeding which corresponds to a selection range of the sheet feeding cassette.

Figure 17:
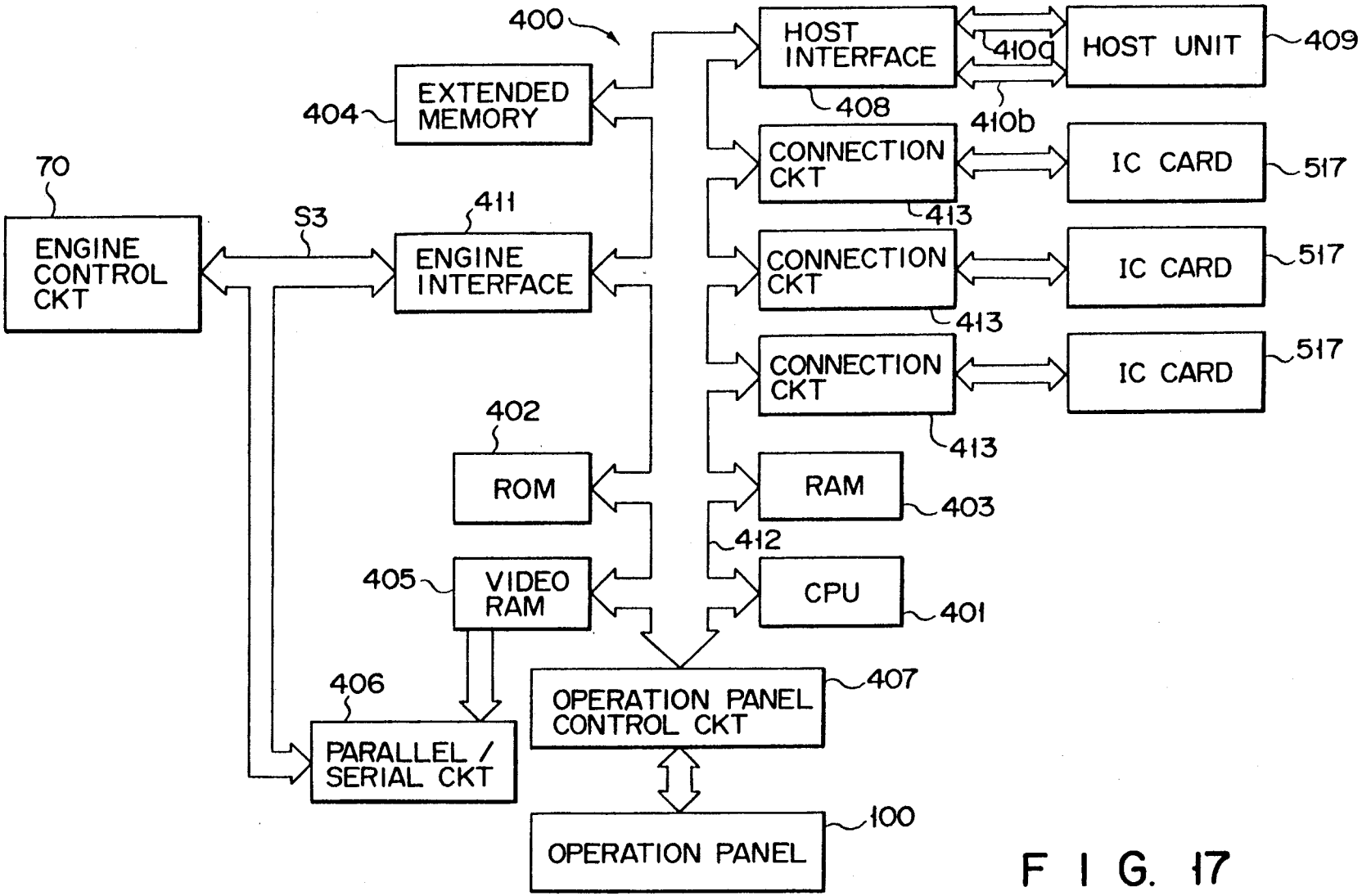
FIG. 17 is a block diagram showing an arrangement of a major section of a printer control section shown in FIG. 15.

For example, upon the depression of the menu next-item key 100*c* with the display [AUTO:M-U] on the liquid display unit 100*a*, the auto change range, that is, the continuation contents is set as [M-U], meaning that the display contents from the sheet feeding cassette 22 to the sheet feeding cassette 20 is set. The continuation contents is stored in RAM 403 (FIG. 17). In this case, when the sheet feeding cassette 22 becomes empty upon the feeding of the sheet from the sheet feeding cassette 22 without continuously feeding a sheet from the sheet feeding cassette 31 with letter heads placed therein, a setting is made to allow the sheet P to be fed from the sheet feeding cassette 30.

The contents corresponding to the continuation sheet feeding processing can be changed during a portion of the processing by depressing the value next-item key for a corresponding designation to be made.

A plurality of auto change ranges, that is, the continuation contents, displayed on the liquid crystal display unit 100*a* are stored in ROM 402 and the auto change set range, that is, the continuation contents, is stored in RAM 403 as shown in FIG. 17.

The arrangement of the engine control unit will be explained below.

Figure 15:
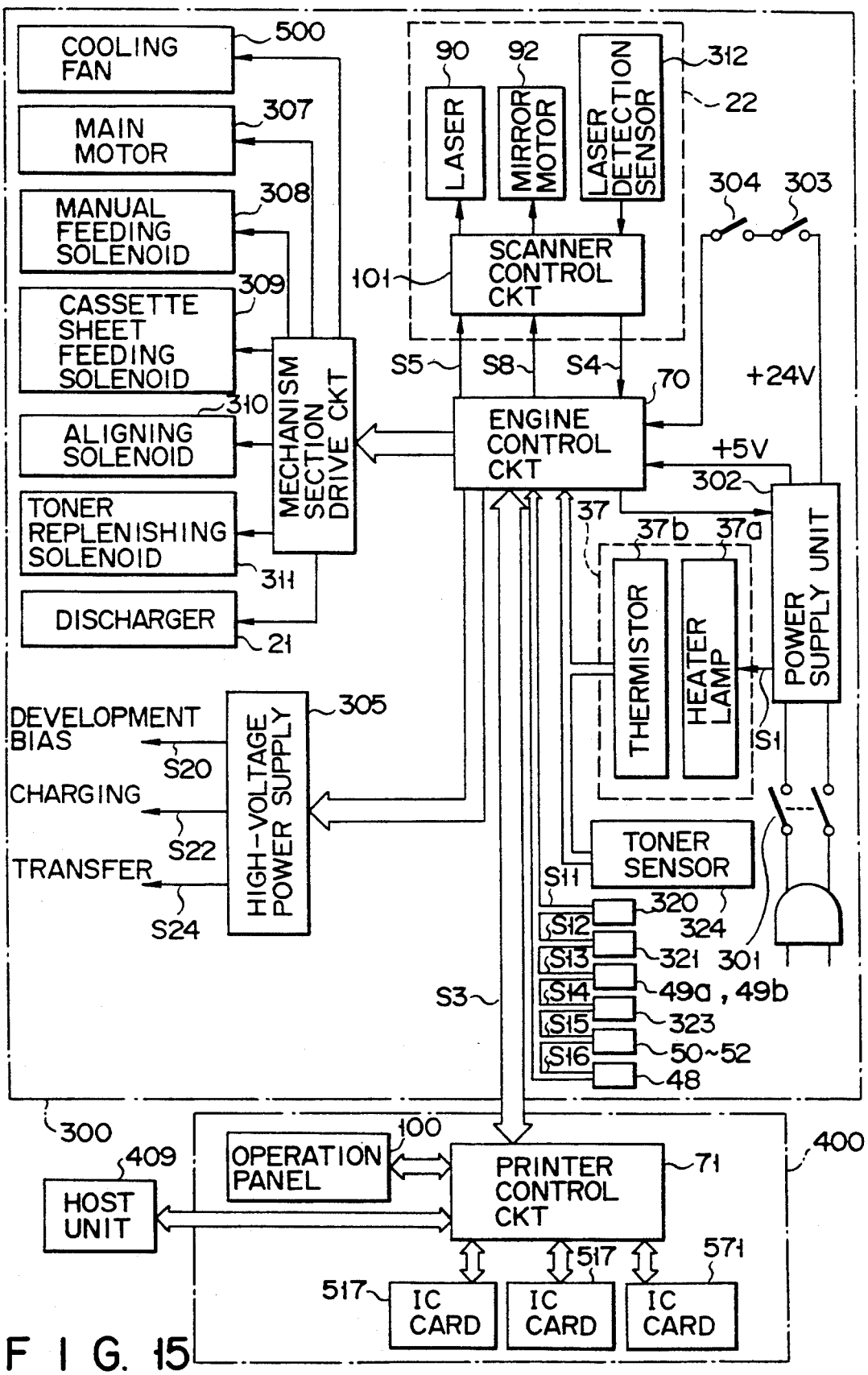
FIG. 15 is a block diagram showing an arrangement of a major section of an engine control section.

FIG. 15 is a block diagram showing an arrangement of a major section of the engine control unit 300. In FIG. 15, reference numeral 302 represents a power supply unit. Power supply voltages +5 V and +24 V are delivered as outputs with the main switch 301 turned ON. The power supply voltage +5 V is supplied to the engine control circuit 70 and from there to the printer control circuit 71 in a print control section 400. On the other hand, the power supply voltage +24 V is fed via cover switches 303 and 304 to the engine control circuit 70. The voltage is supplied via the engine control circuit 70 to a scanner control circuit 101, high voltage power supply 305 and mechanism section drive circuit 306. That is, the voltage is supplied from the scanner control circuit 101 to a semiconductor laser 90 and mirror motor 92, and from the mechanism section drive circuit 306 to a pre-exposure unit 21, main motor 307, manual sheet feeding solenoid 308, cassette sheet feeding solenoid 309, aligning solenoid 309, aligning solenoid 310, toner replenishing solenoid 311, cooling fan 500, etc., and is used as a drive power supply source for each associated part.

A zero-crossing switch type heater lamp drive circuit, not shown, is provided within the power supply-unit 302 and comprised of, for example, a photo-triac coupler and triac which drive the heater lamp 37*a* in the fixing unit 37. The voltage +24 V is employed as a drive power supply for the photo-traic coupler's light emission side LED. In the heater lamp drive circuit of such an arrangement as well known in the art, upon the turn ON or turn OFF of the light emission side LED, the light-emission side photo-traic is turned ON and OFF at a zero-crossing point of an AC power supply. By so doing, a triac of the next-stage major switch element is turned ON and OFF to allow a conduction or cut-off of the AC power supply S1 to the heater lamp 37*a*. A heater control signal S2 for turning the light emission LED ON and OFF is supplied from the engine control circuit 70 to the power supply unit 302. A temperature signal detected by a thermistor 37*b* in the fixing unit 37 is supplied to the engine control circuit 70.

The cover switch 303 is switched OFF upon the upward OFF upon the opening of the cover switch 304. Since the voltage +24 V is cut off by the switches 303 and 304 with the top cover or the rear cover opened, the operations of the semiconductor laser 90, mirror motor 92, high-voltage power supply 305, main motor 307, respective solenoids 308 to 311, cooling fan 500, heater lamp 37*a*, etc., are stopped and the operator encounters no adverse influence from the device body 1 even if touching the device body 1.

Figure 16:
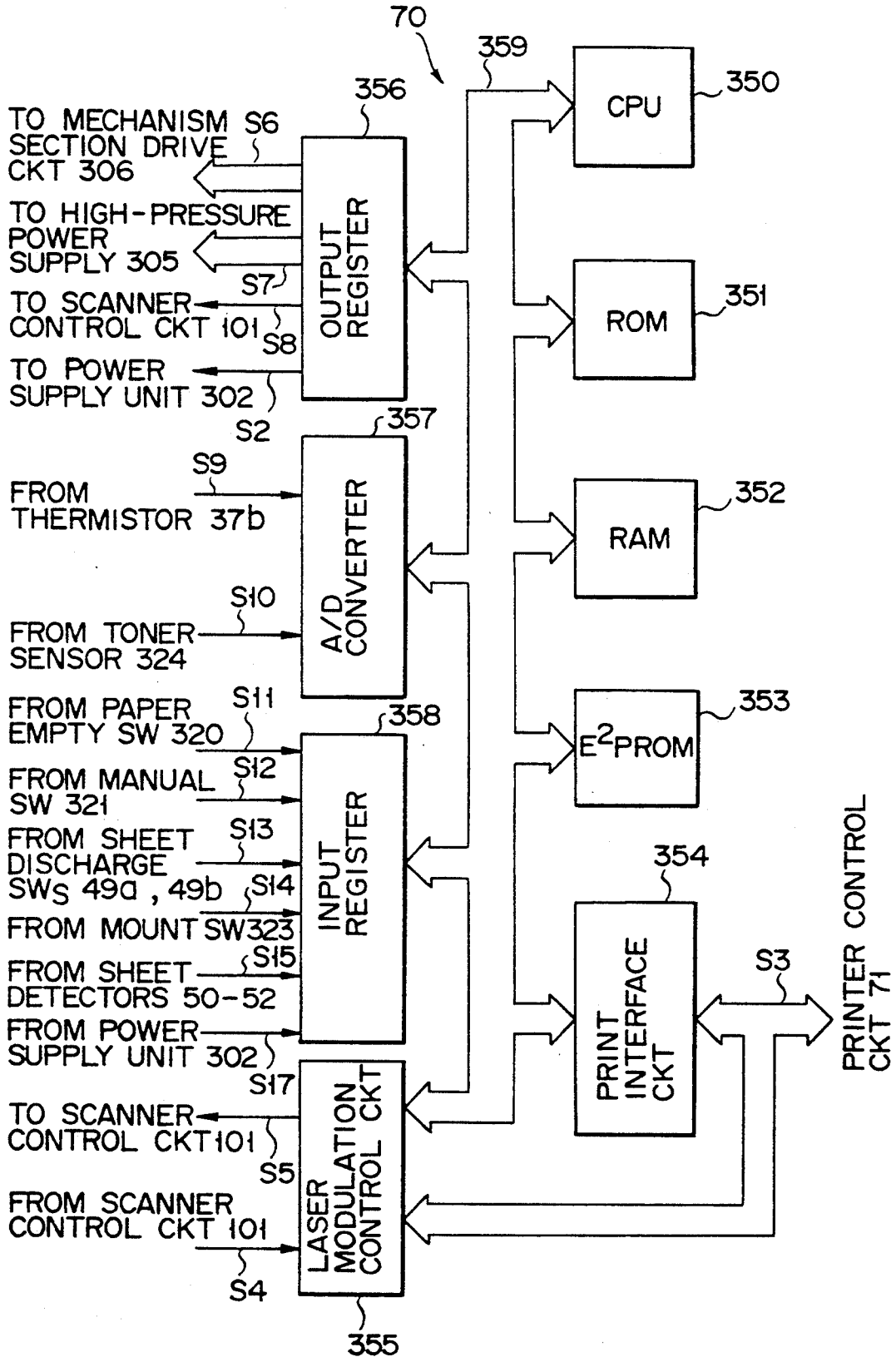
FIG. 16 is a block diagram showing an arrangement of an engine control circuit shown in FIG. 15.

FIG. 16 is a block diagram showing the arrangement of the engine control circuit 70. In FIG. 16, a CPU (central processing unit) 350 wholly controls the engine control unit 300. It is operated in accordance with a control program stored in ROM 351. RAM 352 is employed as an operation buffer for CPU 350. For example, a total number of print sheets are stored as data in EEPROM 353. A printer interface circuit 354 mediates a transfer of an interface signal S3 to the printer control circuit 71. A laser modulation control circuit 355 periodically controls a forced lighting of the semiconductor laser 90 via the scanner control circuit 101 so as to receive a laser beam detection signal S4 from the scanner control circuit 101, modulation-controls the semiconductor laser 90 in accordance with image data sent as an interface signal S3 from the printer control circuit 71 and delivers a laser modulation signal S5 to the scanner control circuit 101. The output register 356 delivers control signals S6, S7, S8 and S2 which control the mechanism section drive circuit 306, high-pressure power supply unit 305, scanner control circuit 101 and heater lamp drive circuit 302, respectively. Voltage signals S9 and S10 are produced at the thermistor 37*b* and toner sensor 324, respectively, and supplied to an A/D converter 357 where their voltage values are converted to digital values. State signals S11, S12, S13, S14, S15 and S16 are delivered from a paper empty switch 320, manual feeding switch 321, sheet discharge switches 49*a* and 49*b*, mount switch 323, sheet detectors 50 and 52 and aligning switch 48 to an input register 358, respectively, and a 24 V ON/OFF state signal S17 is delivered from the power supply unit 302 to the input register 358. An internal bus 359 allows a transfer of data to and from CPU 350, ROM 351, RAM 352, $E_2$-PROM 353, printer interface circuit 354, laser modulation control circuit 355, output register 356, A/D converter 357 and input register 358.

A drive circuit for driving various motors and solenoids is provided in the mechanism section drive circuit 306 and ON/OFF-controlled by a binary control signal S6 supplied from the output register 356 in the engine control circuit 70. For example, each drive circuit is turned ON when the binary signal [1] is involved and turned OFF when the binary signal 0] is involved and, by so doing, allows a supply or cut-off of the voltage +24 V to or from the discharger 21, main motor 307, solenoids 308 to 311 and cooling fan 500. The scanner control circuit 101 includes a drive circuit for the semiconductor laser 90 and mirror motor 92. The semiconductor laser 90 is ON-OFF controlled, through the scanner control circuit 101, with the use of a laser modulation signal S5 delivered from the laser modulation control circuit 355 in the engine control circuit 70.

The mirror motor 92 is ON-OFF controlled, through the scanner control circuit 101, with the use of a control signal S8 which is output from the output register 356 in the engine control circuit 70. A PIN diode is employed in a laser beam detection sensor 312 and, upon the passage of a laser beam through the laser beam detection sensor 312, a current flows in an amount proportional to that light energy. The current signal is supplied as a laser beam detection signal S4 to the laser beam modulation control circuit 355 through the scanner control circuit 70. A developing bias signal S20, charging signal 22 and transfer signal S24 are delivered as high-voltage signals from the high-voltage power supply unit 305 to a developing bias power supply section, not shown, charger 18 and transfer unit 20, respectively. These parts are ON-OFF controlled by the control signal S7 delivered as a binary signal [1] or [0] from the output register 356. At set out above, in an engine control section 300, a power supply is applied through the engine control circuit 70 to each electric circuit and each part is controlled by a control signal which is delivered as a binary signal from the engine control circuit 70. The engine control section 300 is connected by an interface signal S3 to the printer control section 400.

The arrangement of the printer control section 400 will be explained below.

FIG. 17 shows an arrangement of a major section of the printer control section 400. In FIG. 17, CPU 401 controls a whole of the printer control section 400. ROM 402 stores a control program and CPU 401 operates in accordance with the control program. ROM 402 stores a code number to which reference is made upon the change of data, data on the sheet p, such as a margin, left margin and paper type, message information to be informed to the operator, and a plurality of auto change ranges, that is, the continuation contents. RAM 403 is employed as a page buffer for temporarily storing image data to be sent from the host unit 409 and stores, as data, the connection states of the option units and set auto change ranges, that is, the continuation contents.

An extended memory 404 is comprised of a largecapacity memory which is employed when RAM 403 cannot store one-page data in the case where image data sent from the host unit 409 is larger in quantity, such as a bit map data. A video RAM 405 stores image data developed on a bit image and the output of the video RAM 405 is supplied to a parallel/serial conversion circuit 406. The conversion circuit 406 converts the image data of the form of a developed bit image which is sent as parallel data from video RAM 405 to serial data which in turn is output to the engine control circuit 70.

A host interface 408 allows data transfer between the host unit 409 comprised of, for example, an electronic computer or image read-out device and the printer control section 400 via two kinds of lines: a serial transfer line 410*a* and parallel transfer line 410*b*. These lines are properly used, in a selective way, relative to the host unit 409 in accordance with the kinds of data involved. An engine interface 411 allows a transfer of an interface signal S3 between the printer control circuit 71 and the engine control circuit 70. Upon the insertion or withdrawal of an IC card or cards 517 into or out of the connector or connectors, not shown, a connection circuit 413 cuts off a power supply or a signal line to the IC card 517, thereby preventing data which is stored in the IC card 517 from being destroyed by a noise produced at the time of insertion or withdrawal.

An operation panel control circuit 407 performs various control operations, such as the display of information messages on the liquid crystal display unit 100*a* of the operation panel 100, lighting, extinguishing and ON/OFF flashing of the LED display unit 100*b*, and delivery to CPU 401 of data entered from a menu next-item key 100*c*, menu previous-item key 100*d*, value next-item key 100*e*, value previous-item key 100*f* and on-line key 100*g*. An operation bus 412 permits data transfer to and from CPU 401, ROM 402, RAM 403, extended memory 404, video RAM 405, operation panel control circuit 407, host interface 408, engine interface 411 and connection circuit 413.

The IC card 517 is comprised of a nonvolatile memory, such as a battery back-up type static RAM, EEPROM, EPROM or mask ROM. The IC card 517 stores, for example, a character font and emulation program.

CPU 401 ascertains whether or not connection is made to the option units, such as the multi-cassette feeder 2, an envelope feeder 3, and a jogger 4, through a transfer of their connection signal and stores a result of asertainment in RAM 403.

Figure 18A:
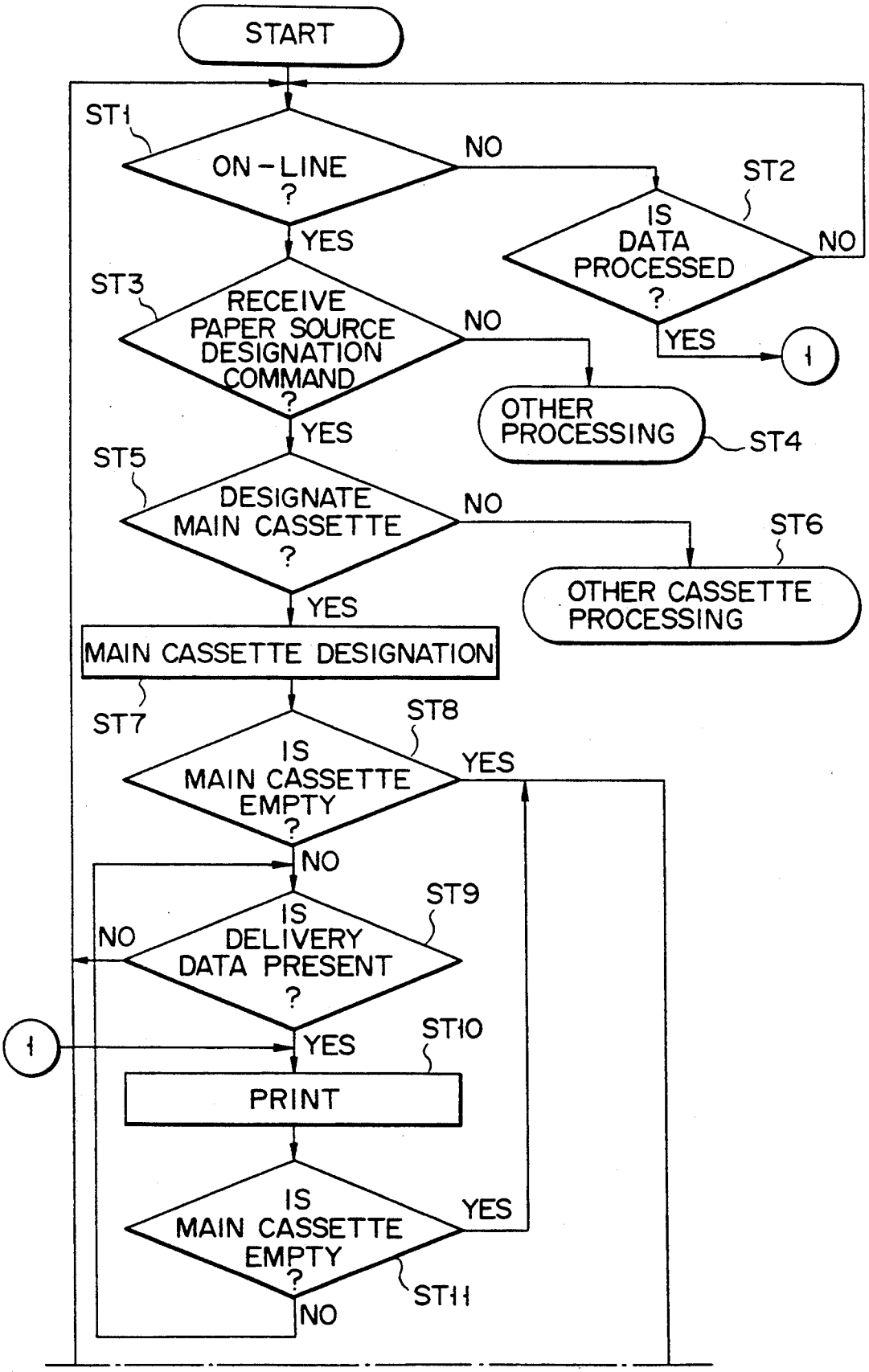
Figure 18B:
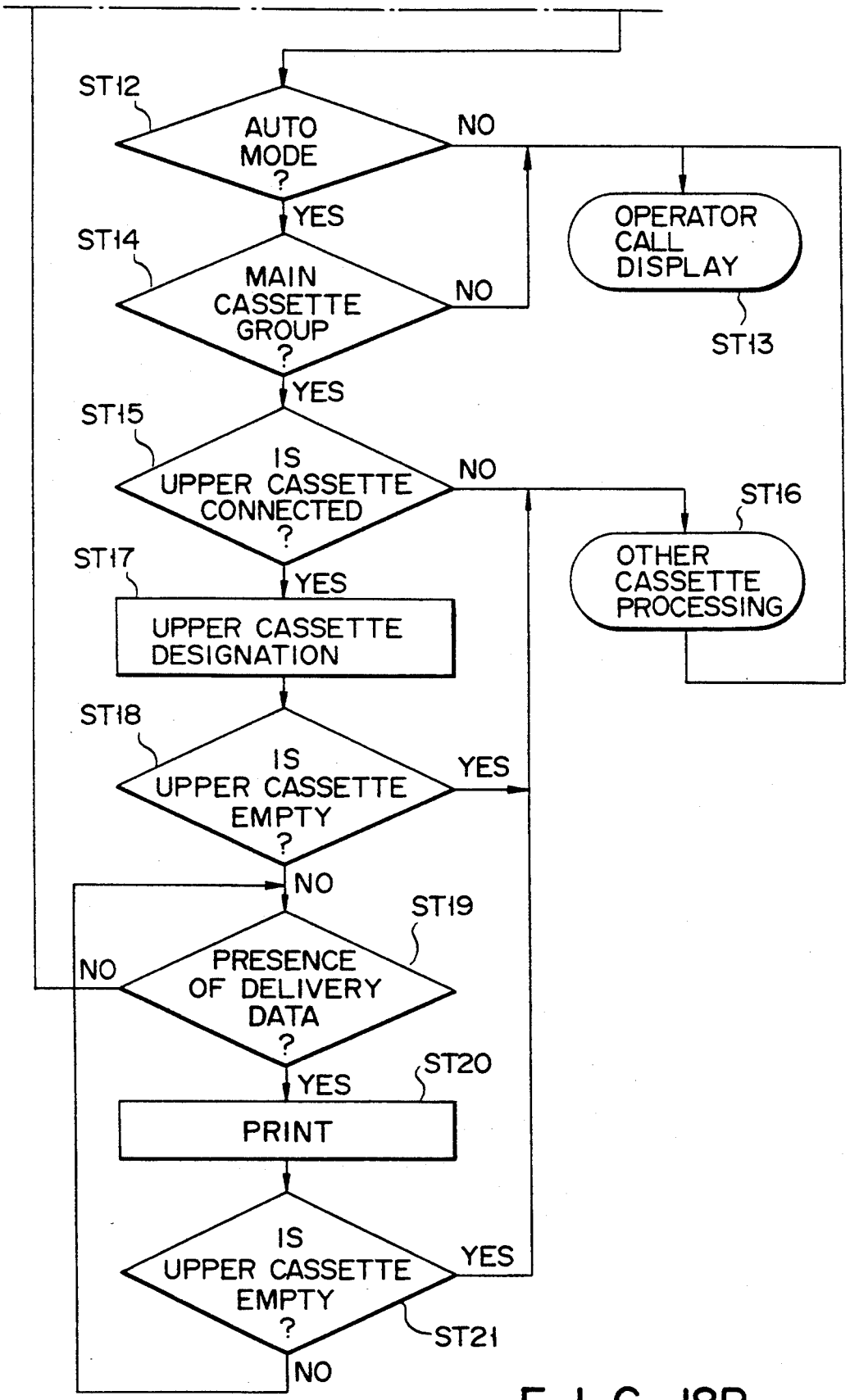

The operation of the printer control circuit 400 will be explained below with reference to FIGS. 18A and 18B.

Upon the depression of the menu next-item key 100*c* with the menu selected as the continuation function set mode and a display [AUTO:M-U] made on the liquid crystal display unit 100*a*, the auto change range, that is, the continuation contents, is set, meaning that the sheet feeding cassette 30 is selected subsequent to the sheet feeding cassette 22.

Now let it be assumed that, for example, the laser printer 1 is placed in off-line. If at this time it is determined by CPU 401 that the off-line state is involved at step ST1, examination is made, at step ST2, as to whether or not a previous print processing has been completed on data received from the host unit 409. If not, control is branched to step ST10 to continue the print processing. If, on the other hand, the print processing has been completed, steps ST1 and ST2 are executed repeatedly, producing an idling state in readiness for the laser printer's on-line state.

When, in such a state, the laser printer 1 is made on-line, data sent from the host unit 409 is examined at step ST3 to see whether or not it comes from a paper source designation command. In the absence of the paper source designation command, other processings are carried out at step ST4. It is determined whether or not the paper source designation command designates the sheet feeding cassette 22 at step ST5. If not, step ST6 carries out other cassette processings, e.g., processings for cassette 30.

In the presence of a designation command for the sheet feeding cassette 22 at step ST7, it is determined, by a detection signal of the sheet detector 50, whether or not the sheet feeding cassette 22 is empty (step ST8). If the cassette 22 is not empty as a result of execution by the processing at step ST4, that is, the presence or absence of data to be delivered to the engine control circuit 70 is determined at step ST9. In the presence of the delivery data, printing is carried out through the engine control circuit 70 at step ST10. After printing has been done, checking is made at step ST11 to see whether or not the sheet or sheets P are still left in the sheet feeding cassette 22. If the answer is affirmative, control goes back to step ST9 where checking is made to see whether or not there exists such delivery data. In the absence of the delivery data, control goes back to step ST1.

In the absence of the sheet P at steps ST8 and ST11, it is determined, at step ST12, whether or not the auto change range, that is, the continuation contents, is set. If it is not set, the sheet is not left in the cassette involved and an operator call is displayed on the liquid crystal display unit 100*a* at step ST13. If, on the other hand, it is set, it is determined whether or not the set range belongs to a group involving the sheet feeding cassette 22 (step ST14). Since, in this case, the sheet feeding cassette 30 is set subsequent to the sheet feeding cassette 22, control goes to step ST15 and checking is made to see whether or not the sheet feeding cassette 30 belongs in the group involved. The above descriptions were given, referring to the case where "AUTO:M-U" is selected as the continuation function set mode. As regards the flowchart shown in FIG. 18B, however, the following description is applicable to the case where "AUTO:M-U-L" is selected. That is, if it is not determined in step ST15 that the upper cassette (or the sheet feeding cassette 30) is connected, a check is made to see whether or not another cassette corresponding to "L" belongs in the group involved. If it is determined that the cassette corresponding to "L" belongs in the group, the processing for that cassette is executed in step ST16. In this case, the sheet feeding cassette 30 is designated at step ST17 and an operation similar to that at steps ST8 to ST11 is carried out at steps ST18 to ST21. If the absence of the sheet P is detected at steps ST18 and ST21, control goes to step ST16 for the other processing to be carried out. If another cassette is not designated in the group involved, the sheet is determined as being empty and an operator call is displayed on the liquid crystal display unit 100*a* of the operation panel 100 at step ST13.

The other processing of the ST16, like steps ST5 and ST7 to ST21, is done for each of the other cassettes.

The processing of step 10 will be explained below with reference to the flow chart of FIG. 19.

At step ST9, if image data is determined as being received, it is sequentially stored in a page buffer at step ST31. Further, examination is made at step ST32 as to whether or not a print request is issued at step ST32. If, here, the print request is determined as being not issued, it is determined that a print ready state on the engine side has not been completed. Control goes back to step ST1 and the series of steps is again performed, waiting for the issuance of a print request. If, on the other hand, it is determined that the print request has been issued, the readiness of the print is determined as being completed on the engine groups and a corresponding processing is done as a subsequent operation at step ST16.

Since, in this case, the sheet feeding cassette 30 belongs in the group involved, the sheet feeding cassette 30 is designated at step ST17 and an operation similar to that at steps ST8 to ST11 is carried out at steps ST18 to ST21. If the absence of the sheet P is detected at steps ST18 and ST21, control goes to step ST16 for the other processing to be carried out. If another cassette is not designated in the group involved, the sheet is determined as being empty and an operator call is displayed on the liquid crystal display unit 100*a* of the operation panel 100 at step ST13.

The other processing of the ST16, like steps ST5 and ST7 to ST21, is done for each of the other cassettes.

The processing of step 10 will be explained below with reference to the flow chart of FIG. 19.

At step ST9, if image data is determined as being received, it is sequentially stored in a page buffer at step ST31. Further, examination is made at step ST32 as to whether or not a print request is issued at step ST32. If, here, the print request is determined as being not issued, it is determined that a print ready state on the engine side has not been completed. Control goes back to step ST1 and the series of steps is again performed, waiting for the issuance of a print request. If, on the other hand, it is determined that the print request has been issued, the readiness of the print is determined as being completed on the engine control section 300 and a print command is issued at step ST33.

Then examination is made at step ST34 to see whether or not the storage of one page has been completed. If the answer is negative, the ON/OFF flashing of the "data" lamp is started on the LED display unit 100*b* of the operation panel 100 at step ST35. Then control goes back to step ST1, performing the series of steps and waiting for image data of one page to be stored in the page buffer. If it is determined that the image data of one page has been completed through a repeated series of steps, the "data" lamp is extinguished at step ST36, terminating the data reception processing. The step involved goes to step ST37 for print processing.

When storing the image data of one page in the page buffer is accomplished, examination is made at step ST37 to see whether or not the scan buffer on the video RAM 405 is filled. If the scan buffer is not filled, CUP 401 converts 64 lines of the image data which is stored in the page buffer to bit image data of a character image and stores it in the video RAM (scan buffer) shown in FIG. 17 (step ST38). If the scan buffer is filled, control skips over step ST38.

Examination is made at step ST39 to see whether or not a VSYNC command has already been delivered. If the command is determined as being not delivered, checking is made at step ST40 to see whether or not a VSYNC request is issued from the engine side. If the VSYNC request is determined as being not issued, control goes back to step ST1 and the series of steps is again carried out, waiting for an issuance of the VSYNC request. If it is determined at step ST40 that the VSYNC request has been issued, the VSYNC command is delivered to the engine side at step ST41. Control goes back to step ST1, waiting for the entry of a horizontal synchronizing signal HSYNC and video clock VCLKO.

If, in such a state, the VSYNC command is determined as already having been issued at step ST39, checking is made at step ST42 to see whether or not the transfer of one page of the image data is completed. If the answer is negative, a 64-line's bit image stored in the scan buffer is delivered as the image data to the engine side in synchronism with the horizontal synchronizing signal HSYNC and video clock VCLK (step ST43). On the other hand, CPU 401 returns control back to step ST38, waiting for the completion of one-page's image data while carrying out the series of operation again. Upon the completion of the one-page's image data transfer, control goes back to step ST1 and the printer control circuit 71 regains its initial state, enabling the transfer of the next page's image data to be done.

Figure 20A:
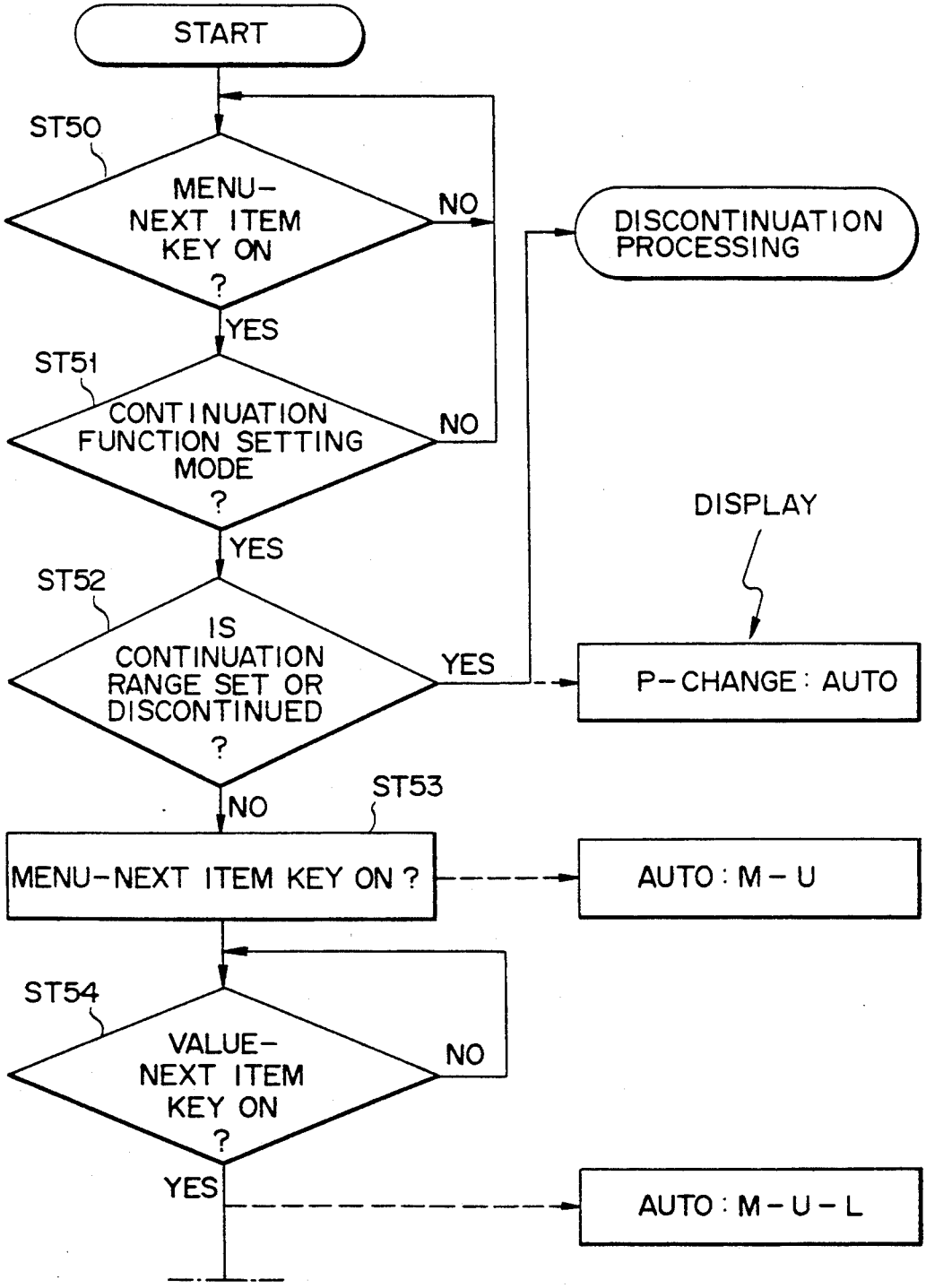
FIGS. 20A and 20B are a flow chart showing an operation for changing the order of priority for a sheet storage section selected during a continuous sheet feeding processing.
Figure 20B:
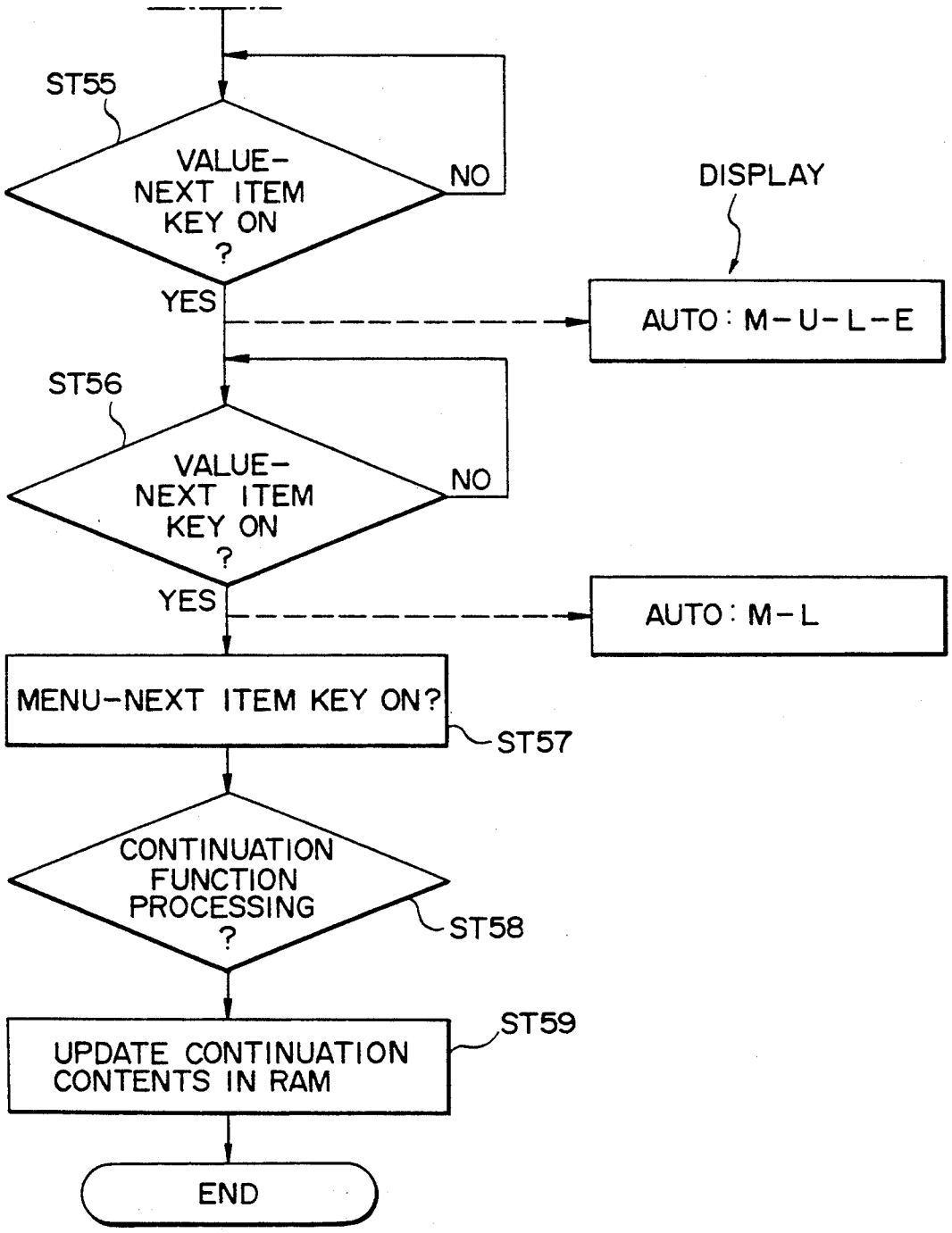

Even during a portion of the continuation processing corresponding to the aforementioned contents [M-U] meaning that the sheet feeding cassette 30 is selected subsequent to the sheet feeding cassette 22, it is possible to change the continuation contents (continuation sheet feeding order) with the continuation function setting mode set on the operation panel 100. The flow of changing the continuation contents will be explained below with reference to FIGS. 20A and 20B.

For example, upon the depression of the menu next-item key 100*c* with the continuation function setting mode selected with the menu next-item key 100*c* and value next-item key 100*e* on the operation panel 100 so that display [AUTO:M-U] is made on the liquid display unit 100*a* (ST50). As step ST50, it is determined whether or not a continuous function setting mode is set (ST51), and, if the answer is in the affirmative, it is determined whether or not a previous continuous designation order is discontinued (Step 52). If the answer is affirmative, then a discontinuance processing is conducted. If, on the other hand, the answer is negative, [P-CHANG:AUTO] meaning that a selection order change function is automatically performed is displayed on the liquid crystal unit 100*a*. Then the menu-next item key 100*c* is depressed (ST53) and a setting change is made to an automatic switching range, that is, a continuation order from the sheet feeding cassette 22 to the sheet feeding cassette 31, enabling [AUTO:M-U] to be displayed.

In order to change the continuance order, the value-next item key 100*e* has only to be sequentially depressed (ST's 54, 55, 56). By so doing, [AUTO:M-U-L], [AUTO:M-U-L-E] and [AUTO:M-L] are displayed on the display unit 100*a*, setting the order of selection for the sheet feeding cassette. After the selection priority order has been changed during a sheet feeding process, the menu-next key 100*c* is depressed (ST57) to confirm whether or not the continuous function mode is now involved (ST58). If the answr is affirmative, the continuance contents is stored in RAM for updating (ST59). In this way, it is possible to arbitrarily select a proper sheet storage section for the sheet feeding continuation processing and to change the order of priority with which the sheet is selected from the sheet storage section during a portion of the sheet feeding.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

a plurality of housing members, each accommodating a recording medium;

means for feeding the recording medium from one of the housing members;

means for forming an image on the recording medium fed from the housing members by the feeding means;

means, operable by an operator of the image forming apparatus, for determining an order of the feeding operation of the feeding means with respect to the housing members;

means for selecting a first housing member which is determined to be a first order of the feeding operation by the determining means;

means for changing the order of the feeding operation determined by the determining means while the feeding means feeds the recording medium from the first housing member; and means for operating the selecting means to switch-over from the first housing member to a second housing member which is determined to be a second order of the feeding operation by the changing means when the recording medium in the first housing member is empty, so as to continuously feed the recording medium by the feeding means.

2. An image forming apparatus according to claim 1, further comprising:

detecting means for detecting an amount of the recording medium fed from the housing member during a portion of a processing for feeding the recording medium; and said determining means comprises means for selecting a continuation function setting mode; and means for selecting an order of the feeding operation of the feeding means with respect to the housing members while the continuation function setting mode is being selected.

* * * * *